US005933972A

United States Patent [19]

Springer, Jr.

[11] Patent Number: 5,933,972

[45] Date of Patent: Aug. 10, 1999

[54] SIGHT FOR FIREARMS

[76] Inventor: Horace L. Springer, Jr., 89 Hickory Pl., Newark, Del. 19702-4008

[21] Appl. No.: 08/929,465

[22] Filed: Sep. 15, 1997

Related U.S. Application Data

[60] Provisional application No. 60/027,078, Sep. 30, 1996.

[51] Int. Cl.[6] ..... F41G 1/02

[52] U.S. Cl. ..... 33/244; 42/101

[58] Field of Search ..... 33/244, 241, 243, 33/253; 42/101

[56] References Cited

U.S. PATENT DOCUMENTS

| | | | |
|---|---|---|---|
| D. 94,514 | 2/1935 | Redfield . | |
| 468,803 | 2/1892 | Harris . | |
| 607,344 | 7/1898 | Cooper | 33/243 |
| 795,584 | 7/1905 | Daniel | 33/243 |
| 986,375 | 3/1911 | French | 33/244 |
| 1,466,297 | 8/1923 | Genard . | |
| 1,989,863 | 2/1935 | Humeston . | |
| 2,002,324 | 5/1935 | Lefever . | |
| 2,256,411 | 9/1941 | Russell | 33/241 |
| 2,645,017 | 7/1953 | Haase . | |
| 2,795,048 | 6/1957 | Seymour et al. . | |
| 3,820,248 | 6/1974 | Hayward | 33/244 |
| 3,882,609 | 5/1975 | Troutman | 33/245 |
| 4,841,659 | 6/1989 | Williams . | |
| 5,519,941 | 5/1996 | Yusko . | |

FOREIGN PATENT DOCUMENTS

| | | |
|---|---|---|
| 262402 | 7/1913 | Germany . |
| 159075 | 2/1921 | United Kingdom . |

*Primary Examiner*—Charles T. Jordan
*Assistant Examiner*—Denise J Buckley
*Attorney, Agent, or Firm*—Richard C. Litman

[57] ABSTRACT

A rear sight is provided for use in conjunction with a firearm. The rear sight includes a base member which is secured to the firearm, and a tubular shroud which is integrally formed with the base member. A targeting plate containing a notch therein is disposed within the tubular shroud in a manner perpendicular to the base member. A viewing aperture of mushroom configuration is subsequently defined to allow a shooter to sight a target in conjunction with the front sight.

6 Claims, 2 Drawing Sheets

SIGHT FOR FIREARMS

CROSS-REFERENCE TO RELATED APPLICATION

This application claims the benefit of U.S. Provisional Patent Application Ser. No. 60/027,078, filed Sep. 30, 1996.

BACKGROUND OF THE INVENTION

1. Field of the Invention

The present invention relates to sighting devices and, more particularly, to those sighting devices capable of being readily mounted onto any type of personal, hand-held or shoulder mounted combat firearm.

2. Description of Prior Art

A variety of sighting devices are known for aiming firearms and the like. Firearms typically employ two sights that are spaced from one another along a line substantially parallel to the path along which a projectile will be discharged. A user holds the firearm manually so as to view over and/or through the two spaced sights toward the target, and discharges the firearm. Adjustments can be made mechanically on the sight, or manually by the user, to adjust for windage and elevation. In any event, the objective is to align the firearm accurately with the target by viewing along a line to the target, as defined by the spaced sights, and holding the firearm along that line.

Various modern sights include the open sight, the peep sight, and the scope. Open sights are typically used on handguns and rifles. An open sight includes a front sight in the form of a blade member which is located at the extreme front end of the firearm. The rear sight is in the form of a planar member having a horizontal notch therein. The rear sight is typically positioned along the barrel or over the chamber portion of the firearm. To aim the firearm, a shooter aligns the front sight with the notch in the rear sight. The firearm is aligned vertically by setting the top edge of the front sight even with the top of the notch in the rear sight. The firearm is aligned laterally by centering the front sight within the notch. The intended target should now appear just against the top of the front blade. The front and rear sights are dimensioned to place the discharged projectile on the target viewed within a certain range, provided the sights are properly aligned.

In practice, the rear sight is closer to the shooter than the front sight, and the target is a substantially greater distance away. Thus, it is necessary for the shooter to choose where to focus his or her eyes. If the shooter focuses on the target, the sights will appear blurred. If the shooter focuses on the sights, the target will appear blurred. A similar situation is encountered when the shooter attempts to focus on the front or rear sights. This situation is not as pronounced, however, because the distance between the front and rear sights is small.

While shooters can shift their focus between the sights and the target, they are taught to focus on the sights when discharging the firearm, rather than the target. This allows the shooter to concentrate and clearly center the front and rear sights. While it is not necessary for the target to be in focus when the firearm is aimed, the reverse is not true. Misalignment of the sights will result in a missed shot even if the target can be clearly seen.

As a result of the above limitations, open sights are generally accurate only for targets within a local focal range of 25 meters for most handguns, although some rifles include open sights which are graduated to greater distances.

As the distance to the target is increased, the view of the target degrades and accuracy declines rapidly. Telescopic sights are helpful for longer distances in that the cross hairs can be arranged such that they appear focused when viewing a target through the sight. However, telescopic sights are expensive and easily damaged.

Various sighting devices have been proposed for improving the accuracy of firearm sights. For example, U.S. Pat. No. 468,803 issued on Feb. 16, 1892 to Harris discloses a front gun sight comprising a vertical longitudinal blade enclosed by a circular shroud. The invention allows different styles of sights to be combined with a single sight block so as to be interchangeable in their use. The different sights may be quickly and easily substituted for another without the aid of a screwdriver or any other special tools.

U.S. Pat. No. 1,466,297 issued on Aug. 28, 1923 to Genard discloses a sight for firearms comprising an anterior solitary blade and a posterior peepsight. The peepsight works in conjunction with ordinary front sights to form a proper aim.

U.S. Pat. No. 1,989,863 issued on Feb. 5, 1935 to Humeston discloses a front sight for firearms comprising an anterior shrouded longitudinal blade. The shroud is slidably attached to the blade member.

U.S. Pat. No. 2,002,324 issued on May 21, 1935 to Lefever discloses a gun sight comprising an extensively enclosed rear peep sight and a shrouded anterior solitary blade. The invention also includes means for removably mounting the rear sight tube upon the barrel and for holding the same in proper alignment therewith.

U.S. Pat. No. 2,645,017 issued on Jul. 14, 1953 to Haase discloses an anterior shrouded gun sight having an interior longitudinal blade. The invention may be easily adapted for use with rifles or pistol type firearms.

U.S. Pat. No. 2,795,048 issued on Jun. 11, 1957 to Seymour et al. discloses a detachable rear sight for shotguns which includes sighting ribs on the barrels. The rear sight may be easily detached so that the object aimed at may be more clearly seen and sighted. A peep sight may be secured to a resilient body member which detachably grips the barrel itself.

U.S. Pat. No. 4,841,659 issued on Jun. 27, 1989 to Williams discloses a dual iron and telescopic sighting systems for the shooter. Iron sights are added to modified telescopic sight upper mounting rings which are attached to conventional telescopic sight lower mounting rings. The rear sighting element may be interchangeably provided with a peep type sight or an open blade sight.

U.S. Pat. No. 5,519,941 issued on May 26, 1996 to Yusko discloses a sight for firearms which require manual alignment with a target along a viewing line. The sights are constructed to provide sufficient visual cues to the shooter to enable effective aiming while focusing on the target rather than the sight. The rear sight is in the form of a planar member perpendicular to the gun barrel and contains a substantially circular central opening. The front sight is in the form of a cylinder whose axis is parallel with the gun barrel.

U.S. Design Pat. No. Des. 94,514 issued on Feb. 5, 1935 to Redfield discloses an ornamental design for gun sight.

German Patent document No. 262,402 published on Jul. 11, 1913 discloses a gun sight system. The invention does not show the dual tongue attachment means, the unitary construction, or the shrouded upright transverse wedge of the present invention.

British Patent document No. 159,075 published on Feb. 24, 1921 discloses a detachable shroud for the front sight of a shotgun. The invention includes a ring which is mounted perpendicular to the line of sight with, its center coincident to the line of sight. The invention is designed such that it may be readily clipped to the dual barrel of a shotgun.

None of the above inventions and patents, taken either singularly or in combination, is seen to describe the instant invention as claimed. Thus a sight for firearms solving the aforementioned problems is desired.

SUMMARY OF THE INVENTION

Accordingly, it is a principal object of the invention to provide a rear sight which provides for quick acquisition of an intended target within the sights at normal, human vision distances.

It is a further object of the invention to provide a firearm sight system that is durable and rugged.

It is an object of the invention to provide improved elements and arrangements thereof in a sight for firearms for the purposes described which is inexpensive, dependable and fully effective in accomplishing its intended purposes.

In accordance with the objects of the invention, a rear sight is provided for use in conjunction with a firearm. The rear sight includes a base member which is secured to the firearm, and a tubular shroud which is integrally formed with the base member. A targeting plate is disposed within the tubular shroud in a manner perpendicular to the base member. The targeting plate also includes a notch which is centrally disposed along its edge. A viewing aperture having a mushroom shape is subsequently defined by the area between the tubular shroud and the targeting plate. In preferred embodiments of the invention, tritium dots may be provided to improve sighting in low levels of light.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
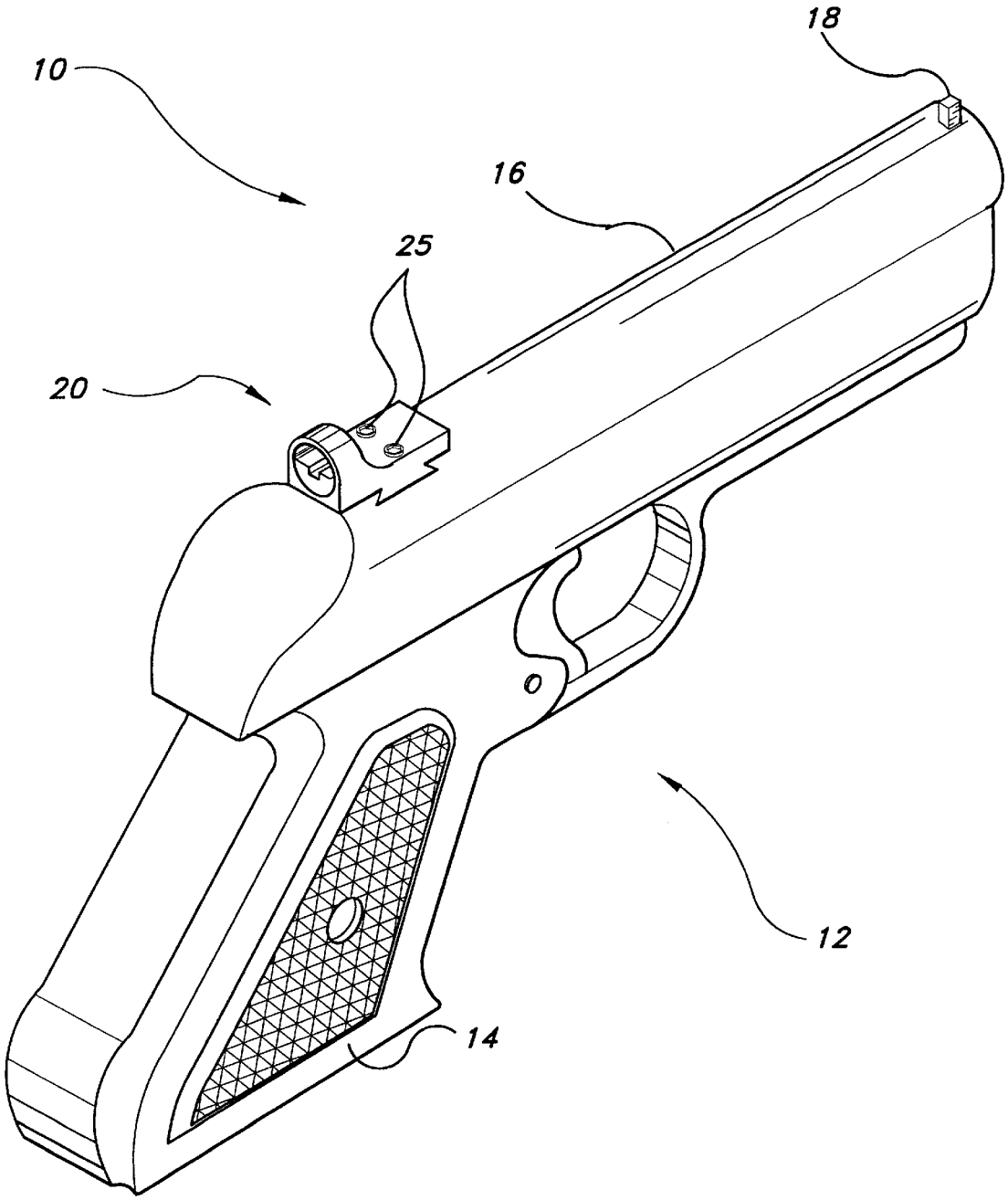
FIG. 1 is an environmental, perspective view of a sight system for firearms according to the present invention.
Figure 2:
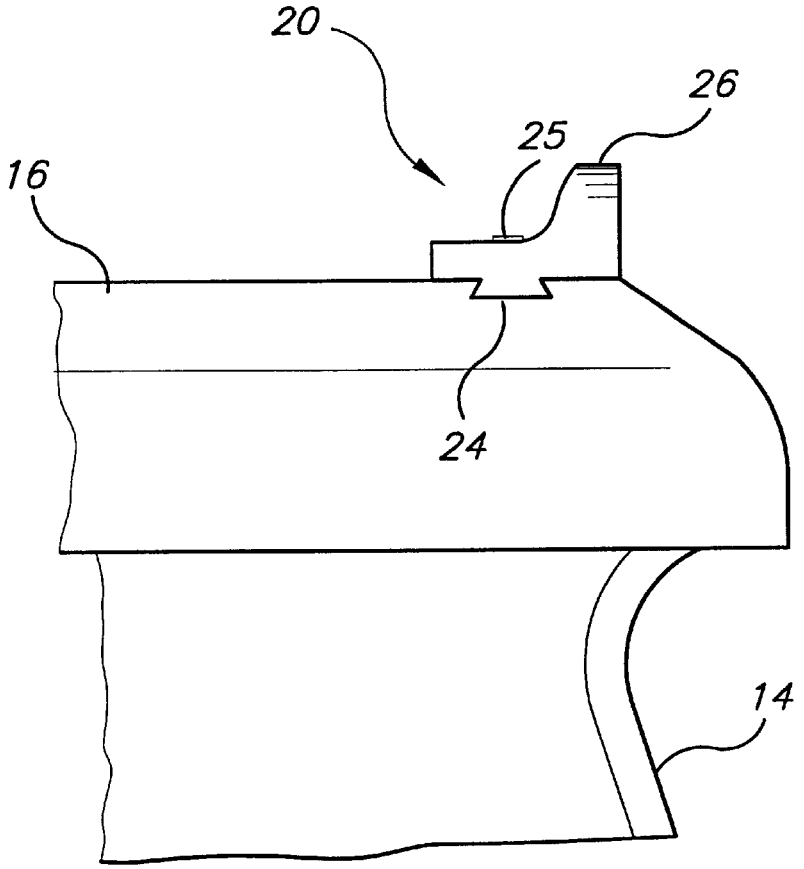
FIG. 2. is an enlarged side elevational view of a rear sight according to the present invention.
Figure 3:
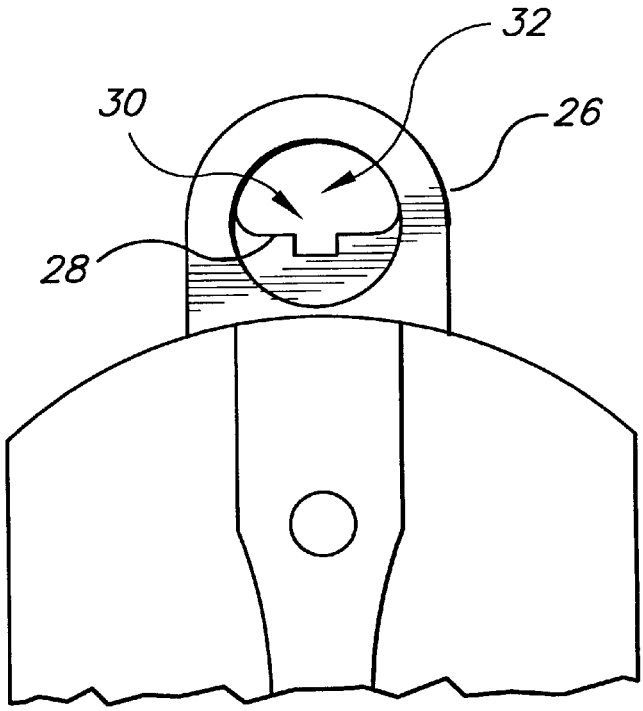
FIG. 3. is a rear elevational view of the rear sight.

Referring now to FIGS. 1–3 of the drawings, a targeting system is shown and generally indicated by the numeral 10. The targeting system 10 includes a firearm such as a handgun 12 and a unique rear sight 20. The handgun 12 includes a handle 14 and a barrel 16 coupled thereto. A front sight 18 is secured to the barrel 16 at a location proximate the muzzle, or outlet thereof.

The rear sight 20 includes a base member 22 which has a generally rectangular configuration and includes a first end and a second end. The first end is directed toward the front sight, while the second end is directed toward the rear of the firearm. The base member 22 is secured to the handgun 12 via a dovetail tongue 24 which is insertable within a corresponding dovetail slot (best seen in FIG. 2) on the handgun 12. Since the rear sight of most handguns is secured in the same fashion, there is no requirement to modify the handgun 12 or any firearm to which the rear sight 20 is mounted. However, it is to be noted that the sight base will be machined to meet each firearms manufacturer's specifications for mounts. A pair of set screws 25 are inserted down through the top of dovetail tongue 24 and against the top surface of the dovetail groove of handgun 10. The set screws 25 allows the user to properly adjust the rear sight 20 for windage, while also allowing the user to secure the rear sight 20 in a fixed orientation.

A tubular shroud 26 is integrally formed with and extends from the second end of the base member 22 in a direction toward the shooter. A targeting plate 28 is disposed within the tubular shroud 26 in a manner perpendicular to the base member 22. The targeting plate 28 extends upward approximately one half of the diameter of the tubular shroud 26. The targeting plate 28 also includes a notch 30 which is centrally disposed along its edge.

The space between the tubular shroud 26 and the targeting plate 28 defines a mushroom shaped aperture 32 of semicircular configuration. The mushroom shaped aperture 32 allows a shooter to aim the handgun 12, or desired firearm, by aligning the front sight 18 within the notch 30 of the targeting plate 28. The mushroom shaped aperture 32 allows the shooter to quickly and accurately sight targets that are within a short range, while the targeting plate 28 allows sighting of targets that are greater distances away. The tubular shroud 26 also functions to reduce glare generated around the mushroom shaped aperture 32 in particularly bright environments.

The rear sight 20 may be constructed of a variety of materials that are durable and wear resistant such as steel, carbon fiber, or any other alloys or composite material. The rear sight 20 may also be adapted for use with various types of firearms including, but not limited to, handguns, rifles, shotguns, machine guns, assault rifles, etc. In preferred embodiments of the invention, tritium dots (not shown) may be imprinted on the targeting plate 28, one on either side of the notch 30. The tritium dots improve a shooter's ability to quickly and accurately sight targets in minimal lighting conditions. A tritium dot can also be imprinted on the front sight 18 in order to improve sighting over long distances.

It is to be understood that the present invention is not limited to the sole embodiment described above, but encompasses any and all embodiments within the scope of the following claims.

I claim:

1. A rear sight for a firearm comprising:

a base member having a substantially flat configuration and including a first end and a second end;

a dovetail tongue extending downwardly from said base member, said dovetail tongue being configured and dimensioned for engaging a complementary dovetail slot contained in the firearm to secure said base member to the firearm;

a tubular shroud extending integrally from said base member, said tubular shroud having a diameter and a hollow interior;

a targeting plate disposed within said tubular shroud, said targeting plate being oriented perpendicularly to said base member, said targeting plate extending upward from said base member approximately half said diameter of said tubular shroud, and said targeting plate having a top edge and containing a notch centrally disposed along said edge, said notch having a pair of parallel side edges extending down from said top edge, and a bottom edge parallel to said top edge;

said base member; dovetail tongue, tubular shroud, and targeting plate together defining a single, integrally formed unit; and a viewing aperture defined by the space between said tubular shroud and said targeting plate, said viewing aperture having a mushroom configuration including a semicircular portion above said target plate's top edge, and a rectangular portion below said target plate's top edge.

2. A targeting system comprising:

a firearm including:

a handle portion designed for cooperation with the shooter's hand;

a barrel coupled to said handle, said barrel including a muzzle; and a front sight disposed on said firearm at a location proximate said muzzle; and a rear sight including:

a base member having a substantially flat configuration and including a first end and a second end;

a dovetail tongue extending downwardly from said base member, said dovetail tongue being configured and dimensioned for engaging a complementary dovetail slot contained in the firearm to secure said base member to the firearm;

a tubular shroud extending integrally from the second end of said base member, said tubular shroud having a diameter and a hollow interior;

a targeting plate disposed within said tubular shroud, said targeting plate being oriented perpendicularly to said base member, said targeting plate extending upward from said base member approximately half said diameter of said tubular shroud, and said targeting plate having a top edge and containing a notch centrally disposed along said edge, said notch having a pair of parallel side edges extending down from said top edge, and a bottom edge parallel to said top edge;

said base member, dovetail tongue, tubular shroud, and targeting plate together defining a single, integrally formed unit; and a viewing aperture defined by the space between said tubular shroud and said targeting plate, said viewing aperture having a mushroom configuration including a semicircular portion above said target plate's top edge, and a rectangular portion below said target plate's top edge.

3. A targeting system as recited in claim 2, wherein said firearm is a handgun.

4. A targeting system as recited in claim 2, wherein said firearm is a rifle.

5. A targeting system as recited in claim 2, wherein said rear sight is constructed from steel.

6. A targeting system as recited in claim 2, wherein said rear sight is constructed from composite material.

* * * * *